US006054081A

United States Patent [19]

Bielfeldt

[11] Patent Number: 6,054,081

[45] **Date of Patent: *Apr. 25, 2000**

[54] PROCESS FOR THE CONTINUOUS PRODUCTION OF BOARDS OF WOOD-BASED MATERIAL

[75] Inventor: Friedrich B. Bielfeldt, Pahl, Germany

[73] Assignee: Maschinenfabrik J. Dieffenbacher GmbH & Co., Eppingen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/560,095

[22] Filed: Nov. 17, 1995

[30] Foreign Application Priority Data

Nov. 17, 1994 [DE] Germany ..... 44 41 017

[51] Int. Cl.[7] ..... B27N 3/08

[52] U.S. Cl. ..... 264/83; 264/109; 264/113

[58] Field of Search ..... 264/109, 112, 264/113, 280, 123, 125, 126, 128, 83; 156/583.5; 100/93 RP; 425/371

[56] References Cited

U.S. PATENT DOCUMENTS

| | | | |
|---|---|---|---|
| 3,230,287 | 1/1966 | Caron et al. | 264/109 |
| 4,293,509 | 10/1981 | Buecking | 264/26 |
| 5,063,010 | 11/1991 | Fischer et al. | 264/109 |
| 5,284,546 | 2/1994 | Tilby | 264/128 |
| 5,892,208 | 4/1999 | Harris et al. | 219/696 |

FOREIGN PATENT DOCUMENTS

| | | |
|---|---|---|
| 2 058 820 | 5/1972 | Germany . |
| 24 25 638 | 12/1975 | Germany . |
| 39 14 106 | 10/1990 | Germany . |
| 755882 | 8/1956 | United Kingdom . |

*Primary Examiner*—Mary Lynn Theisen
*Attorney, Agent, or Firm*—Foley & Lardner

[57] ABSTRACT

A process and installation for the continuous production of boards of wood-based material, includes the steps of forming on a continuously moving scattering belt, a pressed material mat includes an initial mixture of chips and/or fibers from a scattering station and mixed with binder; precompacting and preheating the pressed material mat between the scattering station and a main pressing region; and bringing into an end form and curing the pressed material with the application of pressure and heat in a main pressing regions. The moisture level of the pressed material mat is less on entry into the main pressing region than the moisture level of the initial mixture in the scattering of the pressed material mat, part of the moisture imparted to it in the scattering being extracted again by hot-air preheating.

46 Claims, 2 Drawing Sheets

PROCESS FOR THE CONTINUOUS PRODUCTION OF BOARDS OF WOOD-BASED MATERIAL

BACKGROUND OF THE INVENTION

The invention relates to a process for the continuous production of boards of wood-based material, primarily chipboards/fiberboards. The invention further relates to a system for carrying out the process according to the invention.

A process is known from DE-B-24 25 638. According to the latter, the intention is to increase the output of finished boards, in particular in the production of chipboards or fiberboards, by a continuously operating press or to reduce the length of the continuously operating press. For this purpose, after a preliminary pressing operation, the pressed material mat is preheated. It has been found to be a disadvantage of this that, after leaving the continuously operating main press, the finished boards still have troublesome steam occlusions, which can be prevented only by expensive and complicated steam removal measures within the pressing zone of the continuously operating main press.

The use of hot gases, primarily highly pressurized steam, in the continuously operating presses is disclosed by DE-A-20 58 820. The superheated steam is fed to the pressed material through the gas-permeable belts (meshed metal belts, or steel belts perforated in the manner of a screen). These gas-permeable steel belts are supported by means of rolling supporting elements, which in turn are supported against a rolling surface. In principle, the feeding of the hot gas takes place within the main press, the feeding of the gas along the pressing zone taking place in terms of rate and temperature within the curing and calibrating zone, that is to say in the high-compaction region of the continuously operating main press. The disadvantage of this apparatus for carrying out the process is that, due to the rolling supporting elements, the superheated steam flows through a relatively long steam-depressurization zone in an uncontrolled manner, and consequently cools to varying degrees. Secondly, the gas-permeable steel belt structure on the surfaces of the chipboards or fiberboards produced gives rise to a marked surface texture, which has to be subsequently ground off, additional production costs arising due to material losses.

A further configuration of the preheating of the pressed material mats by a steam jet is represented by the apparatus published in German Patent 39 14 106, with the advantage that, at least in the main press, nonperforated, smooth steel belts are used, so that no surface markings occur on the finished pressed boards. A novel feature of this patent is the rule for proportioning the residual moisture of the pressed material mat after leaving the steam treatment zone before entry into the pressing nip of the continuously operating main press. This residual moisture, that is the controlled moisture, of preferably 12 percent by weight is set from a pressed material mat whose initial moisture is less than this known controlled moisture, because the water content of the pressed material mat is raised again by the feeding of steam, it being intended for the pressed material mat to be raised in temperature by about 60° Celsius, that is to say to a maximum of 80° C. It has been found to be a disadvantage that the water content of the pressed material mat, increased by the feeding of steam, has to be extracted again, that is to say, contrary to the aim stated as the object, a not inconsiderable part of the pressing zone of the main press is again required for evaporating the moisture introduced, because the finished pressed board is intended, according to practice thus far in technological applications, to leave the continuously operating main press with a residual moisture of about six percent by weight. On account of the increased temperature of the pressed material mat up to 80° Celsius, the controlled moisture of on average 12 percent by weight is no longer required in the full amount as a "means of heat conduction". Furthermore, due to the high entry temperature of about 80° Celsius and the high controlled moisture of about 12.5 percent by weight, the pressed material mat becomes so highly plastic that a higher compaction in the outer layer regions of the boards is possible only to a limited extent. This disadvantage also applies in the same way to the industrial property rights already mentioned above and to the processes described above. Due to the inadequate compaction of the outer layer regions, the usefulness of the boards thus produced is also considerably impaired. That it to say that the boards not only have a lower bending resistance but also an inadequate surface hardness and, as a result, are much less suitable for painting and/or laminating.

The present invention is based on the object of further developing the process of continuously producing boards of wood-based material, primarily chipboards/fiberboards, such that a preheating and precompaction of the pressed material mat is made possible without additional steam-removal measures being required within the main pressing region, it being intended for the preheating temperature to bring about shorter setting and crosslinking times within the continuously operating main press and leading as a result to a marked increase in production with shorter pressing times and also achieving a higher compaction of the outer layer regions in comparison with the middle core region in the finished pressed board. The invention is also based on the object of providing an installation which is particularly suitable for carrying out the developed process.

Also to be mentioned as an advantage of the present invention is that, up until entry into the main pressing region, or up until entry into the run-in nip of the continuously operating press, the pressed material mat is regulated during preheating to a temperature just a little below the initial polymerization of the binder and the moisture level is regulated below the controlled moisture, the initial polymerization temperature generally lying between 60° Celsius and 100° Celsius steam point, depending on the reaction time of the binder.

SUMMARY OF THE INVENTION

The invention provides a process for the continuous production of boards of wood-based material, comprising the steps of forming, on a continuously moving scattering belt, a pressed material mat comprising an initial mixture of chips and/or fibers from a scattering station and mixed with binder, precompacting and preheating the pressed material between the scattering station and a main pressing region bringing into an end form and curing the pressed material mat with application of pressure and heat in the main pressing region; wherein a moisture level of the pressed material mat is less on entry into the main pressing region than the moisture level of the initial mixture in the scattering of the pressed material mat, part of the moisture imparted to it in the scattering being extracted again by hot-air preheating.

The process according to the invention particularly achieves the effect that, with the preliminary press with preheating and moisture conditioning, the pressed material mat is raised from the ambient temperature, equal to or greater than 20° Celsius, to a temperature level of 65° Celsius to 90° Celsius, preferably 80° C.—in any case a little below the initial polymerization point of the binder—with a set moistness of 6 to 12 percent by weight, preferably 9 percent by weight, with the advantage of a higher compaction of the outer layer region in comparison with the middle core region of the board in the apparent density ratio of about 1:0.5 to 1:0.66, and, in a manner corresponding to the difference between the maximum achievable preheating temperature in the preliminary press and the 100° Celsius steam point in the main press, the required heat transfer moisture is set as low as possible, in order that the steam removal zones along the continuously operating main press can be kept as short as possible with about 6 percent residual moisture of the finished board.

The installation for carrying out the process according to the invention comprises a scattering station, arranged above the gas-permeable scattering belt, for forming the pressed material mat, a precompaction press, downstream of which a hot-air heating and drying device is arranged as a preheating device, and a heatable continuously operating main press, wherein according to the invention the installation is constructed as a preliminary press with preheating and moisture-conditioning device which is enclosed in a continuous mode of operation by an upper and a lower gas-permeable screen belt, preferably meshed belt, and thereby forms a closed system, this system having three or four process sections, which comprise a precompaction press, a hot-air heating and drying device, and possibly a steam wetting device for the pressing faces of the pressed material mat, and a postcompaction press.

Preferred refinements and developments of the invention are set out below. Additional objects, features and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DESCRIPTION OF THE DRAWINGS

The accompanying drawings, which are incorporated in and constitute a part of the specification, illustrate a presently preferred exemplary embodiment of the invention, and, together with the general description given above and the detailed description of the preferred embodiments given below, serve to explain the principles of the invention.

DETAILED DESCRIPTION OF THE PREFERRED EMBODIMENTS

Figure 1:
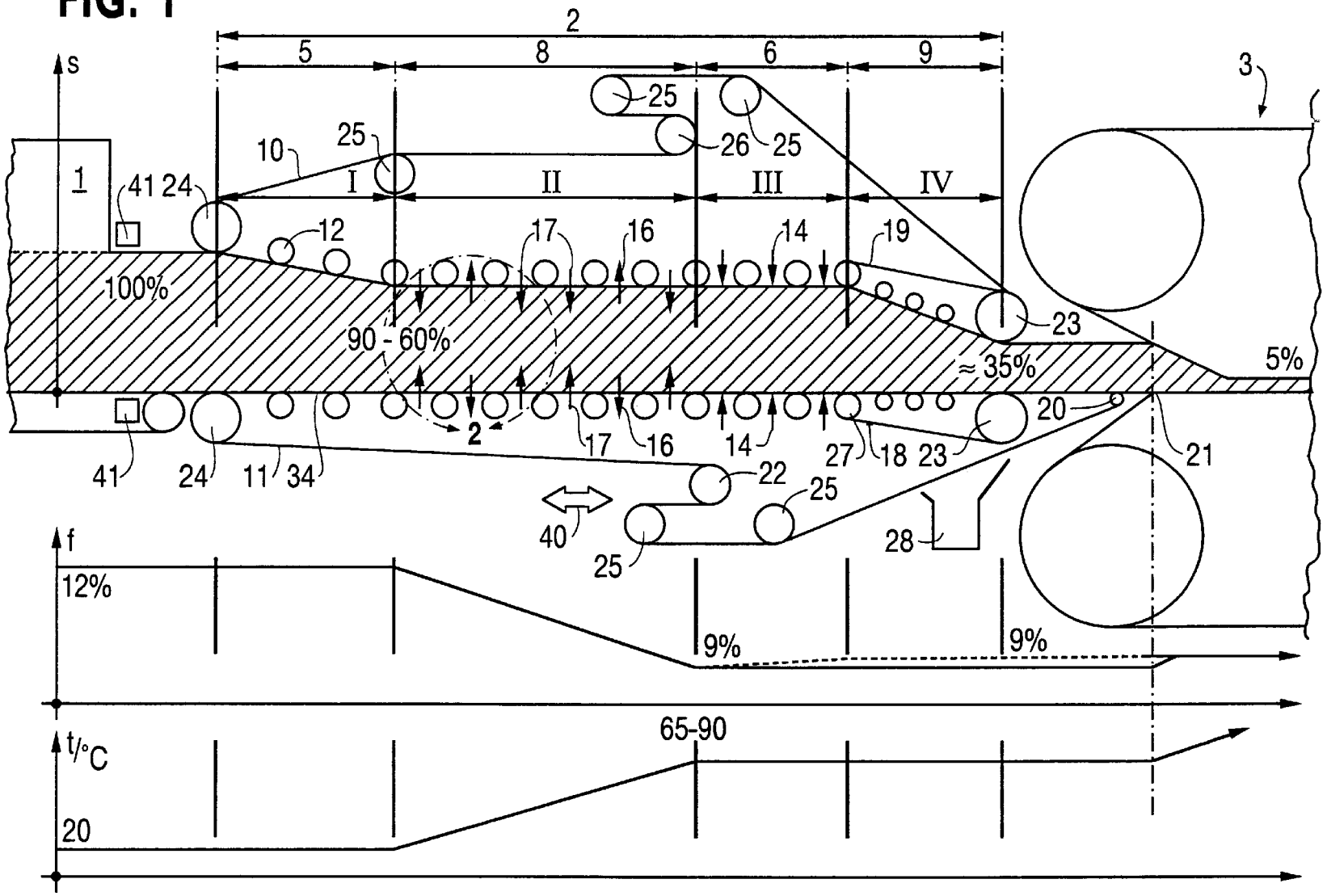
FIG. 1 shows in a diagrammatic representation the installation for carrying out the process according to the invention.

At the forefront of the teaching here of the process according to the invention is that the pressed material mat in the preliminary press must only be set to a moisture level below the controlled moisture in order to achieve the residual heat transfer in the main press up to 100° Celsius steam point of the binder for adequate curing of the pressed material mat in the main press, the evaporating out of water being reduced to a minimum extent of the pressing zone. This teaching is based on the technologically novel finding that, at a temperature reached by the pressed material mat of 65° to 90° Celsius, preferably 80° Celsius, on entry into the pressing nip of the main pressing zone, a moisture level of 6 to 12 percent by weight, preferably 9 percent by weight, is adequate to achieve complete curing in the continuously operating main press without having to provide an appreciable steam removal zone therein. As a result of the invention, the pressing zone of the continuously operating main press can be made shorter, since no excess moisture of several percent by weight has to be evaporated out, which has the consequence of a reduction in costs. Also, such a press can be installed in a smaller production hall.

Consequently, it is to be recorded as a novel technological finding from the invention that, at a pre-heating temperature of about 80° Celsius, the previously customary controlled moisture of up to 15 percent by weight is no longer required. This is because the controlled moisture of up to 15 percent by weight derived from conventional continuous press technology arises from the necessity that the presence of the cell moisture of the aqueous binder is required for the heat transfer from the outer layers to the middle of the pressed material mat. Since the kick-off temperature for curing and crosslinking of the board is generally at 100° Celsius, with a preheating temperature of 65° to 90° Celsius reached in the preliminary press with a preheating and moisture-conditioning device within the main pressing zone, the 100° Celsius limit is reached much earlier in the middle of the pressed material mat. That is to say the previously applicable teaching of operating with a controlled moisture of 15 percent by weight in the case of a preheating temperature of about 80° Celsius is not technologically advisable or necessary any longer after the finding from the process according to the invention.

For the uniform and accelerated heating through and moistening through of the pressed material mat according to the invention, it is decisive that the pressed material mat runs through the following process steps comprising measures in a preliminary press with preheating and moisture conditioning:

- the scattering of the pressed material mat is performed from an initial mixture with a moisture level as otherwise usual,
- after slight precompaction with adequate permeability, that is to say adequate freedom for the hot air to flow through the chips/fibers, the pressed material mat is heated to a specifically set temperature level, which bears relation to the polymerization temperature and reaction time of the binder, the increased moisture introduced into it being extracted, and
- even before entry into the main pressing region, the pressed material mat is brought to the otherwise usual degree of precompaction.

It may also be of advantage that the preheating and moisture conditioning is followed, even before the second precompaction, by moistening in a specifically set manner the surfaces of the pressed material mat in order to achieve a limited increase in the surface moisture by steam wetting over the surface area. As a result, the heat transfer from outside to inside is accelerated upon entry into the main press.

The previously customary controlled moisture for the outer layers of the pressed material mat upon entry into the continuously operating main press is 15 percent by weight and above. It has been found that, for the process according to the invention, the moistness of the outer layers brought down by about 2.5 to 6 percent by weight is adequate to ensure optimum outer layer compaction. Within the scope of the invention it is possible to operate with various variants with respect to compaction pressure, temperature and moisture setting within the three to four process zones of the preliminary press with preheating and moisture conditioning. In a preferred embodiment, the hot-air heating and drying zone is advantageously operated at a superatmospheric pressure, the temperature being increased continuously, as a function of the running-through speed, in a plurality of zones with increasing heating, while the moisture level of the pressed material mat is continuously decreased. For this purpose, the hot-air heating and drying device comprises a plurality of chambers.

Represented in the figures is the structural design of the installation for carrying out the process according to the invention, with scattering station 1, continuously operating preliminary press with preheating and moisture conditioning 2, and the continuously operating main press 3. The preliminary press with preheating and moisture-conditioning device 2 according to FIG. 1 is constructed as a self-contained modular unit and is arranged reversibly between the scattering station 1 and the likewise continuously operating main press 3, see reversing arrow 40. In the event of a fault or in the case of servicing, the entire unit can be moved in relation to the scattering station 1 with respect to the fixed roller 22, serving as a fixed point, and the pressed material still present in the preliminary press with preheating and moisture conditioning 2 is directed into a discharge bunker 28.

For detecting and reacting to metal parts in the pressed material mat 4, metal detectors 41 are provided. The modular unit of the preliminary press with preheating and moisture conditioning 2 comprises at the start the precompaction press 5, the hot-air heating and drying device 8, which if need be may be followed by a steam wetting device 6, and the postcompaction press 9, which are respectively enclosed above and below the pressed material mat 4, running through in the same sequence, by the circulating screen belts 10 and 11. The endless screen belts 10 and 11 are in this case driven by the driving drums 23 and at the entry are returned by the deflecting drums 24 via supporting rollers 25 and tensioning rollers 26. In contrast to the devices 5 and 8, the postcompaction press 9 has additional pressing belts 18 and 19, which are deflected by deflecting rollers 27, which are set.

The pressed material mat 4 is in this case supported from the entry (deflecting drums 24) to the exit (driving drums 23) by stationary pressure rollers 12, although the latter are arranged vertically adjustably in the upper press crossbeam (not shown), and the pressing angle of the individual units 5, 6, 8 and 9 can be set. The directional arrows 14, 16 and 17 indicate the direction of the hot-air streams in the hot-air heating and drying zone II, and also of the steam wetting zone III.

The time sequence of the process with regard to compaction s, the moisture regulation f and the raising of the temperature level t of the pressed material mat 4 can be seen over the transporting path. The process is based on a hybrid technology for a combined process sequence between hot-air heating and drying with a constant raising of the temperature level t in the low-pressure range between 0 and 3 bar superatmospheric pressure, in order to be able in principle to keep under control this continuously operating preliminary press system with regard to the feeding of hot gas and compaction of the rectangularly preformed pressed material mat 4 by simple structural means, with at the same time high availability and long service life.

The pressed material mat 4 is compacted from a scattered height s of 100% in the precompaction press 5 to about 95% to 60% of the height of the loose material and is fed to the hot-air heating and drying device 8; in the steam-jet wetting zone III, steam is fed onto the upper side and underside of the pressed material mat 4 over its surface area. In FIG. 1, the moistening of the outer layers is drawn in by dash-dotted lines. In the hot-air zone II, hot air can be fed in and carried away via the lateral bordering sides by corresponding lateral gas passages 37 in the telescopic panelings 29 of the two side borders.

Figure 2:
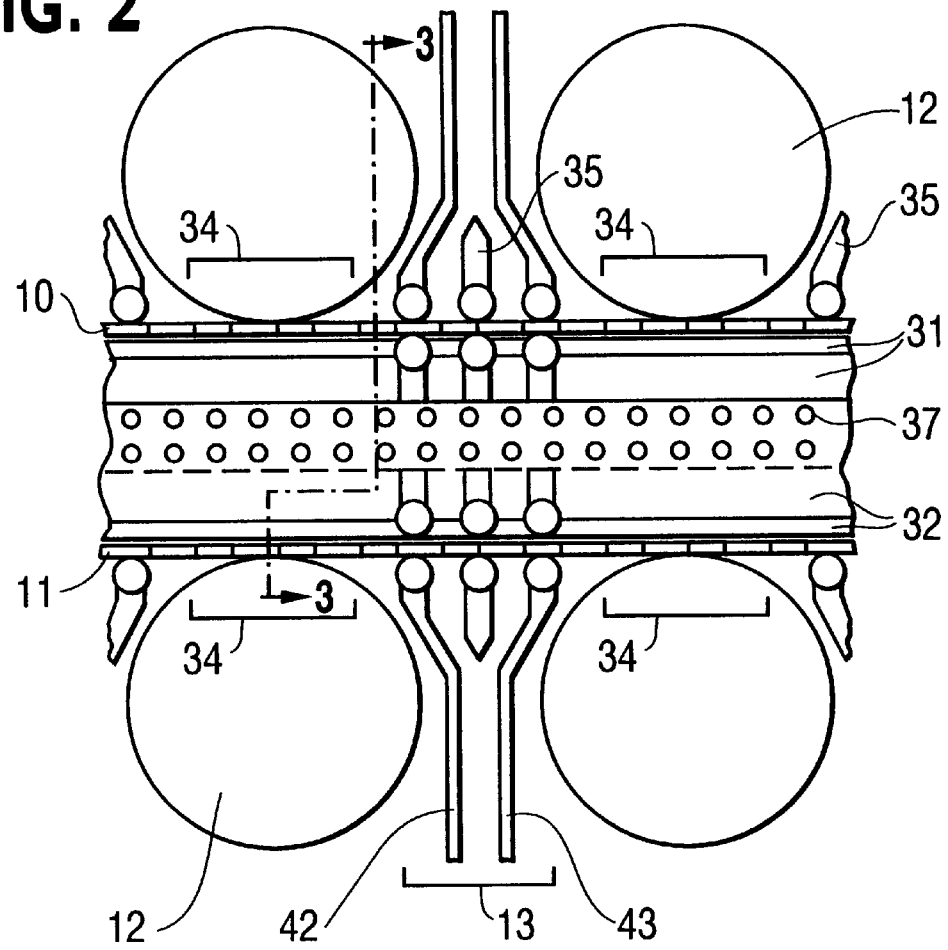
FIG. 2 shows a detail C from FIG. 1 on an enlarged scale.
Figure 3:
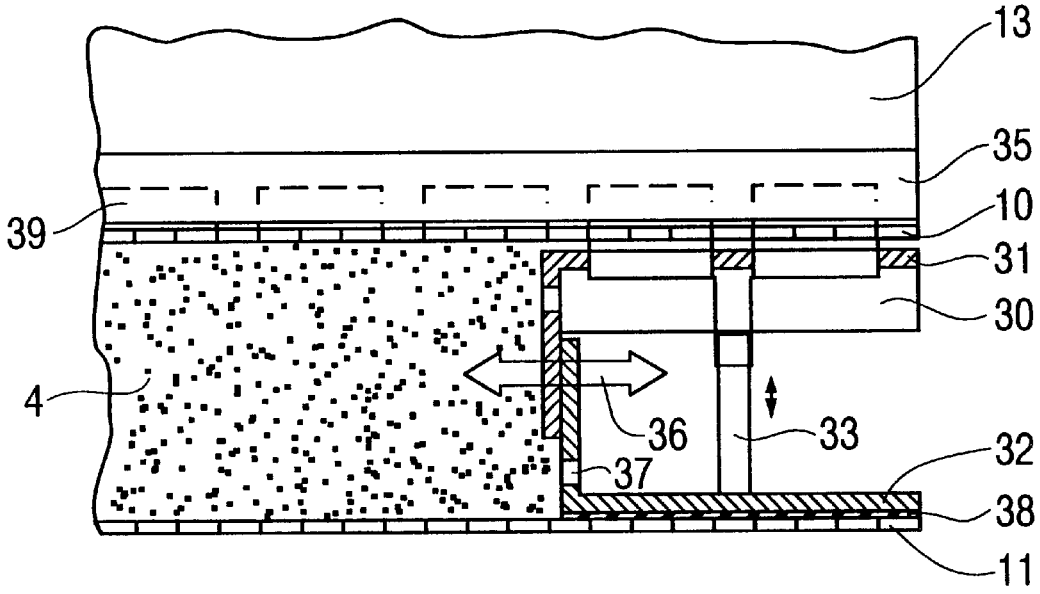
FIG. 3 shows a section a—a from FIG. 2.

Over the pressing face side, above and below, the pressed material mat 4 is restrained in the preliminary press with preheating and moisture conditioning device 2 between the gas-permeable, preferably meshed plastic belts, upper and lower screen belts 10 and 11. On both sides of the nozzle slits arranged in the boxes 13 transversely with respect to the transporting direction, the screen belts 10 and 11 are exactly guided above and below by fixed pressure rollers 12. For better and more gentle support of the screen belts 10 and 11 between the pressure rollers 12 and for better introduction of the hot air into the pressed material mat 4 and steam onto the pressed material mat 4, there are, as revealed by FIGS. 2 and 3, one or more knife-edge rolling strips 35 secured over the entire width of the pressed material mat 4 in the boxes 13. The rollers 39 mounted in the knife-edge rolling strips 35 thereby bring about virtually planar pressing faces between the pressing zones 34 of the pressure rollers 12.

Outside the telescopic panelings 29, acting as side border sealing means, the perforated screen belts 10 and 11 are restrained by an outwardly prolonged supporting roller construction 30 such that they are guided in parallel. The lateral telescopic paneling 29 comprises two angle plates 31 and 32, which are pressed slightly against the upper screen belt 10 and lower screen belt 11 by means of a resilient pressing system 33. To prevent undue stress on the screen belts 10 and 11, there are preferably likewise knife-edge rolling strips 30 provided in the horizontal parts of the angle plates 31 and 32, as a supporting roller construction. Opposite the pressing zone 34, strips 38 (coated with a TEFLON-brand non-stick coating) are fitted in the angle plates 31 and 32. For adaptation to various widths of pressed material mat, the two lateral telescopic panelings 29 can be horizontally adjusted by means of adjusting members, represented as a double-headed arrow 36. The adaptation to various thicknesses of pressed material takes place by vertical displacement of the angle plates 31 and 32 with respect to each other by means of a resilient pressing system 33.

The three knife-edge rolling strips 35 are secured in the side walls 42 and 43 of the boxes 13 by transverse struts. While the short knife-edge rolling strips 30 arranged in line therewith at the longitudinal borders restrain the screen belts 10 and 11, they are fixed in recesses of the angle plates 31 and 32. These securements may be performed by known processes, for example by welding. The boxes 13, serving as pressure and suction boxes for the feeding in and carrying away of the hot gases, are anchored in the upper and the lower press crossbeam (not shown). The boxes 13 have the same structural design both in the hot-air heating and drying device 8 and the steam wetting zone III.

Between the individual transversal pressure and suction boxes 13 with the lateral rolling restraint of the meshed belts 10 and 11 there are located along the zone in the region of the larger pressure rollers 12 of the continuously operating precompaction press 5 capillary sealing means, which are formed by anti-friction plastic coverings, for example adhesively attached TEFLON strips 38.

The degree of compaction or relief in the zones is adjusted according to the respective chip-dependent and/or fiber-dependent degree of flowing through by the hot gases in the hot-air heating and drying zone II. For this purpose, the hot-air heating and drying device 8 comprises a plurality of chambers. By this process, the moisture f is reduced to, for example, 9 percent by weight. In the hot-air heating and drying zone II, hot air at a temperature level t between 80° Celsius and 95° Celsius is fed to the pressed material mat 4 in closed hot-air circulation, the fed-in hot air being controlled in terms of moisture such that the initial moisture of the pressed material mat 4 at the end of the hot-air heating and drying zone II up to before entry into the continuously operating main press 3 lies below the customary controlled moisture.

The adjustable temperature level t at the end of the drying zone II is in direct relationship with the glue binder, to be precise depending on the kick-off temperature and the reaction time of the glue binder. The apparent density profile is adjusted in a specifically set manner after the continuously operating preliminary press with preheating and moisture conditioning device 2 in the continuously operating main press 3 by a corresponding programming of the pressing-displacement and/or pressing-force profile. A pressed material mat 4 with raised temperature level t and moisture content f is highly plastic, so that a specifically set compaction in the outer layer region is not possible and there ensues merely an apparent density profile with the disadvantages already mentioned.

To be able to adjust an optimum apparent density profile in the following main press 3, the temperature level t of the pressed material mat 4 raised by the preheating must be brought down by drying to a lower moisture f of the glue binder. This moisture may be approximately between 6 and 12 percent by weight of moisture, preferably 9 percent by weight. Generally, in the integrated operation of the hot-air drying process sequence, the moisture f of the pressed material mat 4 is controlled such that the entry moisture on entry into the continuously operating main press 3 is below the customary controlled moisture.

The hot air is alternately fed in by means of transversal longitudinal nozzle systems, boxes 13, as compressed air (arrow 17) between the pressure rollers 12 and then removed again by subatmospheric pressure suction from the pressed material mat 4, compacted to about 70% of the initial pressed material mat height (arrow 16), so that as a result a good flowing through of the pressed material mat 4 is produced, with at the same time an automatic cleaning effect of the perforation bores of the upper and lower meshed belts 10 and 11.

In the postcompaction press 9, the pressed material mat 4 is compacted to about 35% of the initial maximum scattered height and, consequently, preconditioned by the preceding devices in the process parameters of density s, temperature t and moisture f, is fed via the transfer lug 20 to the removal point 21 of the continuously operating main press 3. Each process section is separately adjusted mechanically by means of external adjusting members (not shown) in level of compaction, compression angle or depression angle.

On account of the shortened chemical reaction times of the glue binder, the complete preliminary press with preheating and moisture-conditioning device 2 is to be arranged as close as possible in front of the continuously operating main press 3. The continuously operating preliminary press with preheating and moisture-conditioning device 2 is further equipped with the following functions. It is reversible counter to the transporting direction from the forward position in front of the continuously operating main press 3 to a servicing position. The reversing travel 40 counter to the transporting direction is, for example, about 3 meters, so that in the moved-clear position, for example in starting-up operation or in the event of a fault, the pressed material mat 4 can be disposed of in a discharge bunker 28, without the mat having to pass through the continuously operating main press 3. At the same time, this moved-clear position can be used for servicing purposes, both for the continuously operating preliminary press with preheating and moisture-conditioning device 2 and for the continuously operating main press 3, in the run-in region.

The installation is also based on a modular construction of the continuously operating preliminary press with preheating and moisture-conditioning device 2 for different board thicknesses and board widths. Since the continuously operating main press 3 can be used for great differences in board thickness between 2.5 millimeters and, for example 40 millimeters, but a preheating of the pressed material mat 4 is of benefit with regard to a significant minimization of the pressing factor (pressing time in seconds per millimeter of board thickness) from a board thickness of about 16 millimeters, it is expedient with the costs of operating materials in mind, such as supplying energy for steam and hot-air generation, to switch off these integrated systems in the case of thin board production, for example less than 16 millimeters, and to use the continuously operating preliminary press with preheating and moisture-conditioning device 2 merely as a precompaction means for the pressed material mat 4, that is to say for deaeration.

Additional advantages and modifications will readily occur to those skilled in the art. Therefore, the invention in its broader aspects is not limited to the specific details, and representative devices, shown and described herein. Accordingly, various modifications may be made without departing from the spirit of scope of the general inventive concept as defined by the appended claims and their equivalents.

What is claimed is:

1. A process for the continuous production of boards of wood-based material cured by heat and pressure, comprising the steps of:

forming with a scattering station, on a continuously moving scattering belt, a scattering thickness of a pressed material mat comprising a binder mixed with at least one of chips and fibers, the binder having a polymerization temperature, and the pressed material mat being at ambient temperature and having an initial moisture content;

preforming the pressed material mat between the scattering station and a main pressing region, said preforming including precompacting the pressed material mat to between 90% and 60% of the scattering thickness, preheating and moisture conditioning the precompacted pressed material mat to a temperature within 35° C. below the binder polymerization temperature, and compacting the precompacted, preheated and moisture conditioned pressed material mat to approximately 35% of the scattering thickness; and finish-forming the preformed pressed material mat in the main pressing region with concurrent application of pressure for finish-compacting the pressed material mat to approximately 5% of the scattering thickness and heat to at least the binder polymerization temperature.

2. The process as claimed in claim 1, wherein adequate permeability for hot air to flow through the pressed material mat is maintained during precompacting.

3. The process as claimed in claim 2, wherein both an upper-side and an under-side of the pressed material mat are moisture conditioned.

4. The process as claimed in claim 1, wherein the preforming further includes hot air preheating in at least one hot air heating zone continuously increases the temperature of the pressed material mat as a function of running-through speed, the temperature of the preformed pressed material mat reaching 65° Celsius to 90° Celsius.

5. The process as claimed in claim 4, wherein the temperature of the preformed pressed material mat is set at 80° Celsius.

6. The process as claimed in claim 1, wherein the preforming further includes hot air preheating in at least one hot air heating and drying zone continuously decreases the moisture level of the precompacted pressed material mat as a function of running-through speed.

7. The process as claimed in claim 6, wherein the preheating and moisture conditioning includes a steam wetting zone following the at least one hot air heating and drying zone for raising surface moisture of an upper-side and an under-side of the pressed material mat.

8. The process as claimed in claim 2, wherein the moisture level of a middle core region of the preformed pressed material mat before entry into the main pressing region is set between 6 to 12 percent by weight.

9. The process as claimed in claim 8, wherein the moisture level of the middle core region of the preformed pressed material mat is set at 9 percent by weight.

10. The process as claimed in claim 7, wherein a compacting zone follows the hot air heating zone and the steam wetting zone, and wherein the pressed material mat is compacted in the compacting zone at constant temperature and moisture levels.

11. The process as claimed in claim 1, wherein the binder polymerization temperature is approximately 100° Celsius and the precompacted pressed material mat is preheated to between 65° Celsius and 90° Celsius.

12. The precess as claimed in claim 11, wherein the precompacted pressed material mat is preheated to approximately 80° Celsius.

13. A process as claimed in claim 1, wherein the initial moisture content is at least 12% and a preforming moisture content in a middle core region of the compacted pressed material mat is no more than 9%.

14. A process for the continuous production of boards of wood-based material, comprising the steps of:

forming with a scattering station, on a continuously moving scattering belt, a mat comprising a binder mixed with at least one of chips and fibers;

preforming the mat between the scattering station and a main pressing region, said preforming including compacting and heating and moisture conditioning the mat and thus reducing a moisture level in a middle core region of the mat to about 9% by weight before entering the main pressing region; and finish-forming the preformed mat into the boards with concurrent application of pressure and heat in the main pressing region;

wherein outer layer regions of the boards are relatively more compact than the middle core region of the boards.

15. A process for the continuous production of boards of wood-based material, comprising the steps of:

forming, on a longitudinally moving belt, a pressed material mat comprising a binder mixed with at least one of chips and fibers;

preforming the pressed material mat for reducing the longitudinal length of the moving belt, said preforming including precompacting, preheating and compacting the pressed material mat; and finish-forming the preformed pressed material mat with the concurrent application of pressure and heat.

16. The process as claimed in claim 15, wherein the pressed material mat is formed by a scattering station and the finish-forming occurs in a main pressing region, and wherein the preforming reduces a distance between the scattering station and the main pressing region.

17. A process for the continuous production of boards of wood-based material, comprising the steps of:

forming, on a longitudinally moving belt, a pressed material mat comprising a binder mixed with at least one of chips and fibers;

preforming the pressed material mat for increasing the speed of the moving belt, said preforming including precompacting, preheating and compacting the pressed material mat; and finish-forming the preformed pressed material mat with the concurrent application of pressure and heat.

18. The process as claimed in claim 17, wherein the preforming increases the rate of producing the boards of wood-based material.

19. A method for the continuous production of boards from a press material mat including a binding agent, comprising the following steps:

a) spreading with a spreading station the press material mat on a continuously moving gas-permeable spreader band, the press material mat comprising a starting mixture with a first moisture level, the press material mat having an original bulk depth;

b) precompressing the press material mat a predetermined amount;

c) preheating the press material mat to a target temperature level by applying hot air to flow through the press material mat, the temperature level being relatable to a polymerization temperature and reaction time of the binding agent, and simultaneously moisture conditioning the press material mat such that a portion of the moisture in the press material mat is withdrawn;

d) increasing the surface moisture of a bottom and a top surface of the press material mat by a predetermined amount in a steam wetting zone; and e) concurrently applying pressure and heat to cure the press material mat in a main pressing area.

20. The method of claim 19 comprising the additional step of bringing the press material mat to a predetermined precompression thickness before the step of applying pressure and heat.

21. The method of claim 19 wherein the moisture level of the press material mat during the spreading step is approximately 12%.

22. The method of claim 21 wherein the moisture of the press material mat is about 9% after the preheating step.

23. The method of claim 22 wherein the preheating and moisture conditioning step is performed while applying pressure of less than or equal to 3 bar greater than atmospheric pressure on the press material mat.

24. The method of claim 23 wherein the temperature of the press material mat is increased continuously in several zones by applying hot air, the increase occurring as a function of the rate of movement, the temperature level of the air being set between 65° Celsius to 90° Celsius.

25. The method of claim 24 wherein the temperature level of the air is set at 80° C.

26. The method of claim 24 wherein the press material mat is precommpressed in a first precompression zone to a thickness between 95% to 60% of the original bulk depth.

27. The method of claim 26 wherein the step of applying pressure and heat to cure includes compressing the press material mat at a steady temperature and moisture level to a press material mat thickness of about 35% of the original bulk depth.

28. A process for the continuous production of boards, comprising:

forming with a scattering station, on a continuously moving scattering belt, a scattering thickness of a pressed material mat comprising a binder mixed with at least one of chips and fibers;

pre-forming said pressed material mat between the scattering station and a main pressing region, said pre-forming including:

pre-compacting said pressed material mat, preheating and moisture conditioning said pre-compacted pressed material mat with steam, and compacting said pre-compacted, preheated and moisture conditioned pressed material mat; and finish-forming the preformed pressed material mat in the main pressing region by concurrently applying heat and pressure.

29. The process according to claim 28, further comprising:

maintaining said pre-compacting during said preheating and moisture conditioning.

30. The process according to claim 29, wherein said preheating and moisture conditioning increases moisture in an outer layer region of the boards relative to a middle core region of the boards.

31. A process for continuously producing a board by heating and compacting a material mat composing a binder and at least one of chips and fibers, the material mat having an initial temperature, an initial density and an initial moisture content, the process comprising:

pre-compacting the material mat, said pre-compacting producing a pre-compacted material mat having a first density that is greater than the initial density;

pre-heating and moisture conditioning said pre-compacted material mat with steam, said pre-heating and moisture conditioning producing a pre-heated and moisture conditioned mat having a first temperature that is greater in an outer layer region than the initial temperature and having a moisture content in the outer layer region of said pre-compacted material mat that is greater than the initial moisture content in a middle core region of said pre-compacted material mat;

compacting said pre-heated and moisture conditioned mat, said compacting producing a compacted material mat having a second density that is greater than said first density; and finish-forming said compacted material mat with concurrently applied heat and pressure, said finish-forming producing the board having a third density that is greater than said second density and a second temperature that is greater than said first temperature;

wherein said steam heats the material mat temperature from said initial temperature to said first temperature and said finish-forming heats the material mat from said first temperature to said second temperature, and wherein said outer layer region is more dense than said middle core region.

32. The process according to claim 31, wherein a polymerization temperature of the binder is between said first and second temperatures.

33. A process for preliminarily forming a mat before entering a main press, the main press applying heat and pressure to the mat to produce a board having outer layer regions that are more compact than a middle core region of the board, the preliminary forming process comprising:

wetting upper and lower surfaces of the mat with steam for moistening outer layer regions of the mat relative to a middle core region of the mat.

34. The preliminary forming process according to claim 33, further comprising:

compacting the mat.

35. The preliminary forming process according to claim 34, wherein the compacting includes a first compacting before the wetting and a second compacting after the wetting.

36. The preliminary forming process according to claim 35, further comprising:

heating the mat between the first compacting and the wetting.

37. The preliminary forming process according to claim 34, further comprising:

heating the mat before the wetting.

38. The preliminary forming process according to claim 37, wherein the heating decreases moisture content of the mat to a level between 6 and 12 percent by weight.

39. The preliminary forming process according to claim 38, wherein the heating decreases the level to 9 percent by weight.

40. The preliminary forming process according to claim 38, wherein the wetting increases moisture content of the outer layer of the mat to a level between 9 and 12.5 percent by weight.

41. The preliminary forming process according to claim 34, wherein the compacting compresses the mat with a pressure of less than 3 bar superatmospheric.

42. The preliminary forming process according to claim 33, further comprising:

heating the mat.

43. The preliminary forming process according to claim 33, further comprising:

drying the mat before the wetting.

44. The preliminary forming process according to claim 43, wherein the drying decreases moisture content of the mat to a level between 6 and 12 percent by weight.

45. The preliminary forming process according to claim 44, wherein the drying decreases the level to 9 percent by weight.

46. The preliminary forming process according to claim 44, wherein the wetting increases moisture content of the outer layer of the mat to a level between 9 and 12.5 percent by weight.

* * * * *